US007614410B2

(12) United States Patent
Kenowski et al.

(10) Patent No.: US 7,614,410 B2
(45) Date of Patent: Nov. 10, 2009

(54) CHEMICAL CONCENTRATION CONTROLLER AND RECORDER

(75) Inventors: Andy Kenowski, Waukesha, WI (US); Leo F. Bohanon, Oconomowoc, WI (US)

(73) Assignee: Hydrite Chemical Co., Brookfield, WI (US)

( * ) Notice: Subject to any disclaimer, the term of this patent is extended or adjusted under 35 U.S.C. 154(b) by 419 days.

(21) Appl. No.: 11/069,702

(22) Filed: Mar. 1, 2005

(65) Prior Publication Data

US 2006/0196529 A1 Sep. 7, 2006

(51) Int. Cl.
*B08B 3/04* (2006.01)

(52) U.S. Cl. ..... 134/56 R; 134/94.1; 134/100.1; 134/168 R

(58) Field of Classification Search ..... 134/56 R, 134/113, 902, 184, 198
See application file for complete search history.

(56) References Cited

U.S. PATENT DOCUMENTS 2,897,829 A 8/1959 Arrington et al.
3,481,355 A * 12/1969 Watson et al. ..... 137/93
4,635,666 A * 1/1987 Daley et al. ..... 134/172
4,756,321 A 7/1988 Livingston et al.
4,770,196 A * 9/1988 Osswald ..... 134/104.4
4,836,420 A 6/1989 Kromrey
5,047,164 A 9/1991 Corby
5,056,542 A 10/1991 Reinhard
5,064,561 A 11/1991 Rouillard
5,282,889 A 2/1994 Franklin
5,282,901 A 2/1994 Reinhard
5,348,058 A 9/1994 Ruhl
5,364,510 A * 11/1994 Carpio ..... 134/2
5,404,893 A 4/1995 Brady et al.
5,405,452 A 4/1995 Anderson et al.
5,427,126 A 6/1995 Carney et al.
5,453,131 A 9/1995 Chan et al.
5,494,061 A 2/1996 Chan et al.
5,500,050 A 3/1996 Chan et al.
5,533,552 A 7/1996 Ahlers
5,556,478 A 9/1996 Brady et al.
5,674,410 A * 10/1997 Nakajima et al. ..... 216/92
5,681,400 A 10/1997 Brady et al.
5,707,457 A * 1/1998 Yates ..... 134/30
5,759,751 A * 6/1998 Shimizu et al. ..... 430/329
5,845,660 A * 12/1998 Shindo et al. ..... 134/56 R
5,888,311 A 3/1999 Laufenberg et al.
5,924,794 A * 7/1999 O'Dougherty et al. ..... 366/136
6,050,283 A * 4/2000 Hoffman et al. ..... 137/3
6,071,356 A 6/2000 Olsen
6,089,242 A 7/2000 Buck
6,136,362 A 10/2000 Ashton (Continued)

*Primary Examiner*—Frankie L Stinson
(74) *Attorney, Agent, or Firm*—Quarles & Brady, LLP

(57) ABSTRACT

A chemical concentration controller and recorder is disclosed for controlling and recording chemical concentrations in a cleaning system. The invention allows a user to control the concentration of two or more chemicals in the cleaning system simultaneously using either concentration-based feed or timed feed. The invention records and archives chemical concentration data from sensors in the cleaning system tanks or the cleaning system fluid conduits during operation of the cleaning system. The data may then be downloaded by a user and analyzed for efficiency and cost control purposes. For example, the data may indicate the overfeeding of chemicals to the cleaning system or leaking valves in the cleaning system.

40 Claims, 4 Drawing Sheets

U.S. PATENT DOCUMENTS 6,146,008 A * 11/2000 Laederich et al. ..... 366/136
6,161,558 A 12/2000 Franks et al.
6,178,975 B1 * 1/2001 Aoki ..... 134/57 R
6,224,252 B1 * 5/2001 Munroe et al. ..... 366/132
6,261,845 B1 * 7/2001 Verhaverbeke et al. ..... 436/55
6,290,384 B1 * 9/2001 Pozniak et al. ..... 366/136
6,323,033 B1 11/2001 van den Berg
6,391,122 B1 5/2002 Votteler et al.
6,423,675 B1 7/2002 Coughlin et al.
6,432,214 B2 * 8/2002 Bryer et al. ..... 134/10
6,463,941 B1 * 10/2002 Takita ..... 134/57 R
6,572,255 B2 * 6/2003 Husher ..... 366/132
6,584,989 B2 * 7/2003 Taft et al. ..... 134/100.1
6,641,675 B2 * 11/2003 Dryer et al. ..... 134/1
6,764,212 B1 * 7/2004 Nitta et al. ..... 366/114
6,767,408 B2 7/2004 Kenowski et al.
6,767,877 B2 * 7/2004 Kuo et al. ..... 510/175
6,799,883 B1 * 10/2004 Urquhart et al. ..... 366/152.4
6,930,493 B2 * 8/2005 Kaiser et al. ..... 324/663
7,198,753 B1 * 4/2007 Campbell et al. ..... 422/68.1
2002/0119574 A1 8/2002 Berg
2003/0094196 A1 * 5/2003 Siefering et al. ..... 137/93
2003/0127110 A1 7/2003 Reichold et al.
2004/0118432 A1 6/2004 Kenowski et al.

* cited by examiner

CHEMICAL CONCENTRATION CONTROLLER AND RECORDER

CROSS REFERENCES TO RELATED APPLICATIONS

Not applicable.

STATEMENT REGARDING FEDERALLY SPONSORED RESEARCH

Not applicable.

BACKGROUND OF THE INVENTION

1. Field of the Invention

The present invention relates to a device and methods for controlling and recording chemical concentrations in a clean-in-place system or similar automated washer.

2. Description of the Related Art

Food processing equipment, such as that found in dairies, breweries, and carbonated beverage plants, typically includes tanks, pumps, valves and fluid piping. This food processing equipment often needs to be cleaned between each lot of product processed through the equipment. However, the tanks, pumps, valves and piping can be difficult to clean because the various components may be difficult to access and disassemble for cleaning. Because of these cleaning difficulties, many food processing plants now use clean-in-place systems in which the tanks, pumps, valves and piping of the food processing equipment remain physically assembled, and various cleaning, disinfecting and rinsing solutions are circulated by the clean-in-place system through the food processing equipment to effect the cleaning process.

An example clean-in-place cleaning cycle normally begins with a pre-rinse cycle wherein water is pumped through the food processing equipment for the purpose of removing loose soil in the system. Typically, an alkaline wash would then be recirculated through the food processing equipment. This alkaline wash would chemically react with the soils of the food processing equipment to further remove soil. A third step would again rinse the food processing equipment with water, prior to a fourth step wherein an acid rinse would be circulated through the batch processing system. The acid rinse would neutralize and remove residual alkaline cleaner and remove any mineral deposits left by the water. Finally, a post-rinse cycle would be performed, typically using water and/or a sanitizing rinse. Such clean-in-place systems (and associated cleaning compositions) are known in the art, and examples can be found in U.S. Pat. Nos. 6,423,675, 6,391,122, 6,161,558, 6,136,362, 6,089,242, 6,071,356, 5,888,311, 5,533,552, 5,427,126, 5,405,452, 5,348,058, 5,282,889, 5,064,561, 5,047,164, 4,836,420, and 2,897,829.

Devices for the automatic dispensing of cleaning, rinsing and/or sanitizing chemicals to the chemical reservoirs of a clean-in-place system or similar automated washer are also known. For example, U.S. Pat. Nos. 5,681,400, 5,556,478 and 5,404,893 describe a programmable detergent controller where a microprocessor compares a detergent concentration set-point with a detergent concentration from a sensor in a wash tank. Based on this comparison, the microprocessor determines when a solenoid valve should be opened to allow the feeding of detergent solution into the wash tank.

U.S. Patent Application No. 2003/0127110 describes an automatic dispensing system for a washer. A probe sensor measures the electrical conductivity of water within the washer and produces a conductivity measurement. Because detergents are an alkali and or an acid, the water conductivity varies with the detergent concentration. Therefore, by sensing the water conductivity, a control system is able to determine how much detergent is needed to be added at the beginning of a wash cycle. The controller operates a detergent flow control device in a first mode in which the quantity of detergent dispensed into the washer is determined in response to the electrical conductivity of the water. If the conductivity measurement is determined to be unreliable, the controller operates in a second mode in which a predefined quantity of detergent is dispensed into the washer. In the second mode, software turns on the detergent pump a fixed period of time required to dispense the predefined quantity of liquid detergent as specified by the software configuration parameters.

U.S. Pat. No. 5,500,050 describes a detergent dispenser controller for use with a washing device that measures detergent concentration in a tank by measuring the conductivity of the detergent solution in the tank. Whenever the detergent dispenser is powered on, it determines the difference between the measured tank detergent concentration and a specified detergent concentration set point value. The computed difference between the set point and the current detergent concentration are used to compute a detergent feed on time. The detergent dispenser is then turned on for the computed feed on time.

U.S. Pat. Nos. 5,494,061 and 5,453,131 describe a liquid chemical dispensing system for dispensing a plurality of liquid chemicals into a washer. The system includes at least a detergent pump and a rinse agent pump, and a data processor enables a user to set values for a rinse run time parameter, a detergent run time parameter, and a rinse delay time, and stores those parameters in the non-volatile memory.

U.S. Pat. No. 4,756,321 describes a chemical dispenser and controller for industrial washers. The level of detergent concentration in the wash water is measured by a conductivity sensor. The controller converts wash water conductivity measurements into detergent concentration measurements. The controller also monitors the detergent concentration level and generates an alarm if the measured detergent concentration fails to increase by at least a predefined amount while the detergent feeding mechanism is turned on. Another feature of the controller is that it generates an alarm if the measured detergent concentration fails to reach its target level after the detergent feeding mechanism has been on for a predetermined time period.

The known devices for the automatic dispensing of chemicals to the chemical reservoirs of a clean-in-place system may provide for more efficient use of cleaning chemicals. For instance, the overuse of a cleaning chemical can be avoided by measuring the concentration of a cleaning chemical in a wash tank and only adding enough cleaning chemical to keep the wash tank cleaning solution at a predetermined concentration. However, conductivity probes can by fouled over time by chemical build-up thereby providing false indications of the water conductivity. Also, conductivity probes can fail thereby providing no indication of the water conductivity. Systems with fouled or nonfunctioning probes lead to overuse of a cleaning chemical.

Devices for monitoring clean-in-place system wash conditions are also known. U.S. Pat. No. 6,089,242 describes a dairy pipeline washing system including sensors that monitor wash conditions. An example sensor is a wash water pH sensor. The system includes a data processor that receives signals from the sensors and compares predetermined wash parameters with the sensed wash conditions. The data processor allows a user to adjust parameters. Alarm signals are provided for out of range readings to allow for altering the chemical composition. The system also allows an operator to alter the amount of chemical to be dispensed. Also, in U.S. Patent Application No. 2002/0119574 and U.S. Pat. No. 6,323,033, there is described a clean in place system where multiple conductivity sensors are used to determine if a milk line is sufficiently cleaned with cleaning fluid.

The known devices for monitoring clean-in-place system wash conditions may provide for more efficient operation of a clean-in-place system. However, these devices may not be suitable for diagnosing clean-in-place system fluid flow problems such as leaking valves.

Thus, there is still a need for a device and methods for controlling and recording chemical concentrations in a clean-in-place system in order to avoid the overuse of cleaning chemicals and to provide for a diagnosis of clean-in-place system fluid flow problems.

SUMMARY OF THE INVENTION

The present invention satisfies the foregoing needs by providing a chemical concentration controller and recorder for controlling and recording chemical concentrations in a cleaning system. The invention allows a user to control the concentration of two or more chemicals simultaneously using either concentration or timed feed. The invention records and archives concentration data. The data may then be downloaded by a user and analyzed for efficiency and cost control purposes.

In one aspect, the invention provides a control system for a cleaning system. The cleaning system may include a pump for supplying a cleaning chemical to a tank for holding a cleaning mixture of the cleaning chemical and a diluting fluid, a fluid supply conduit in fluid communication with a cleaning location and the tank, a fluid return conduit in fluid communication with the cleaning location and the tank, a source of rinsing fluid in fluid communication with the cleaning location, and a drain in fluid communication with the cleaning location. The control system includes a concentration sensor located in the fluid supply conduit. For example, the concentration sensor may be a pH sensor that measures the concentration of hydrogen ions or a conductivity sensor that measures the concentration of conducting ions. The sensor outputs concentration signals indicative of a concentration of a component (e.g., hydrogen ions, conducting ions) of fluid passing the sensor. The control system also includes a controller having a processor and a data storage means. The processor is in communication with the sensor and the data storage means. The controller executes a program stored in the controller to record in the data storage means a data table including (i) time intervals during a period of operation of the cleaning system, and (ii) concentration values associated with each of the time intervals, the concentration values being derived by the processor from concentration signals received from the sensor. The data table may be analyzed by the user or software in the controller for efficiency and cost control purposes. For example, the data may indicate overfeed of chemicals or leaking valves in the cleaning system as described below.

In this control system according to the invention, the processor may also be in communication with the pump for providing on signals and off signals to the pump for turning on and turning off the pump. The controller also records in the data table pump operating status values associated with each of the time intervals. The pump operating status values indicate the on signals and the off signals provided by the processor to the pump. The control system may also include a second sensor located in a fluid path between the cleaning location and the drain. The second sensor outputs second concentration signals indicative of a concentration of a component (e.g., hydrogen ions, conducting ions) of fluid passing the second sensor, and the controller records in the data table second concentration values associated with each of the time intervals, the second concentration values being derived by the processor from second concentration signals received from the second sensor.

The cleaning system may also include a second pump for supplying a second cleaning chemical to a second tank for holding a second cleaning mixture of the second cleaning chemical and a second diluting fluid where the second tank is in fluid communication with the fluid supply conduit and the fluid return conduit. In this configuration of the cleaning system, the processor is also in communication with the second pump for providing on signals and off signals to the second pump for turning on and turning off the second pump. The controller records in the data table second pump operating status values associated with each of the time intervals. The second pump operating status values indicate the on signals and the off signals provided by the processor to the second pump.

In another aspect, the invention provides a control system for a cleaning system. The cleaning system may include a pump for supplying a cleaning chemical to a tank for holding a cleaning mixture of the cleaning chemical and a diluting fluid, a fluid supply conduit in fluid communication with a cleaning location and the tank, a fluid return conduit in fluid communication with the cleaning location and the tank, a source of rinsing fluid in fluid communication with the cleaning location, and a drain in fluid communication with the cleaning location. The control system includes a concentration sensor located in the tank. For example, the concentration sensor may be a pH sensor that measures the concentration of hydrogen ions or a conductivity sensor that measures the concentration of conducting ions. The sensor outputs concentration signals indicative of a concentration of a component of fluid in the tank. The control system also includes a controller having a processor and a data storage means. The processor is in communication with the sensor and the data storage means. The controller executes a program stored in the controller to record in the data storage means a data table including (i) time intervals during a period of operation of the cleaning system, and (ii) concentration values associated with each of the time intervals, the concentration values being derived by the processor from concentration signals received from the sensor in the tank. The data table may be analyzed by the user or software in the controller for efficiency and cost control purposes. For example, the data may indicate overfeed of chemicals or leaking valves in the cleaning system as described below.

In this control system according to the invention, the processor may also be in communication with the pump for providing on signals and off signals to the pump for turning on and turning off the pump. The controller also records in the data table pump operating status values associated with each of the time intervals. The pump operating status values indicate the on signals and the off signals provided by the processor to the pump.

In this control system, a second sensor may be located in the second tank. The second sensor outputs second concentration signals indicative of a concentration of a component of the second cleaning mixture in the second tank. The controller also records in the data table second concentration values associated with each of the time intervals. The second concentration values are derived by the processor from second concentration signals received from the second sensor in the second tank.

The cleaning system may also include a second pump for supplying a second cleaning chemical to a second tank for holding a second cleaning mixture of the second cleaning chemical and a second diluting fluid where the second tank is in fluid communication with the fluid supply conduit and the fluid return conduit. In this configuration of the cleaning system, the processor is also in communication with the second pump for providing on signals and off signals to the second pump for turning on and turning off the second pump. The controller records in the data table second pump operating status values associated with each of the time intervals. The second pump operating status values indicate the on signals and the off signals provided by the processor to the second pump.

The control system may also include a third sensor located in a fluid path between the cleaning location and the drain. The third sensor outputs third concentration signals indicative of a concentration of a component of fluid passing the third sensor, and the controller records in the data table third concentration values associated with each of the time intervals, the third concentration values being derived by the processor from third concentration signals received from the third sensor.

Any of the aforementioned control systems according to the invention may be operated in a chemical "timed feed" mode. When the processor is in communication with the pump for providing on signals and off signals to the pump for turning on and turning off the pump, the controller may execute a program stored in the controller to provide an off signal to the pump at a predetermined time period after an on signal is provided to the pump. The predetermined time period can be modified in the program using the processor. In other words, the controller activates the pump feed for a user adjustable set time period. The controller may also include a manual activation button to provide the on signal to the pump for initiating pump operation for the set time period.

Any of the aforementioned control systems according to the invention may also operate in a chemical "concentration feed" mode. When the processor is in communication with the pump for providing on signals and off signals to the pump for turning on and turning off the pump, the controller may execute the program stored in the controller to provide an off signal to the pump when a concentration sensor in a tank or a fluid supply conduit outputs a concentration signal of a predetermined concentration value after an on signal is provided to the pump. The predetermined concentration value (also called the set point) can be modified in the program using the processor. In other words, the controller activates the pump feed until the sensor senses a user adjustable set concentration. The controller may also include a manual activation button to provide the on signal to the pump for initiating pump operation until the set concentration is obtained.

The controller may also execute a program stored in the controller to provide an alarm signal if a sensor outputs a concentration signal indicating concentration that goes above a predetermined concentration value or outputs a concentration signal indicating concentration that goes below a predetermined concentration value. For instance, if the concentration of hydrogen ions is being measured by a pH sensor, an upper level pH of 11 could be set in the processor and if the sensor outputs a pH signal indicating pH that goes above 11, a visual or audible alarm will activate. Also, a lower level pH of 3 could be set in the processor and if the sensor outputs a pH signal indicating pH that goes below 3, a visual or audible alarm will activate. Likewise, conductivity set points can be used instead of pH set points. Also, the controller may further include a display for outputting a concentration of a component (e.g., hydrogen ions, conducting ions) of fluid passing one or more of the sensors.

Any of the aforementioned control systems according to the invention may include a controller that can download the data table via an interface to a computer or wirelessly transmit the data table to a computer. This allows for user analysis of the data table for diagnosis and correction of cleaning system problems such as the overuse of cleaning chemicals and defects in fluid flow equipment.

In yet another aspect of the invention, there is provided a method for detecting overuse of a cleaning chemical in the cleaning system. During a period of operation of the cleaning system, the controller records in the data storage means a data table including time intervals during the period of operation of the cleaning system and pump operating status values associated with each of the time intervals. The pump operating status values indicate the on signals and the off signals provided to the pump during the period of operation of the cleaning system. The data table is analyzed and a first length of time in which the pump is on is determined by comparing the time intervals between a pump on signal and the next pump off signal.

Thereafter, during a second period of operation of the cleaning system, the controller records in the data storage means a second data table including second time intervals during the second period of operation of the cleaning system and second pump operating status values associated with each of the second time intervals. The second data table is then analyzed and a second length of time in which the pump is on is determined by comparing the second time intervals between a pump on signal and the next pump off signal. The first length of time in which the pump is on and the second length of time in which the pump is on can then be compared. The comparison could be done with software in the data storage means.

When the second length of time in which the pump is on is greater than the first length of time in which the pump is on by a predetermined amount, overuse of the cleaning chemical in the cleaning system is indicated. In other words, the second length of time of pump feed is greater than would be expected for the cleaning system. Such an unexpectedly lengthy pump feed may indicate fouled or nonfunctioning sensor probes leading to overfeeding of a cleaning chemical because a concentration set point is never sensed by the probe.

In still another aspect, the invention provides a method for detecting the leaking of a valve in the cleaning system. The cleaning system includes a tank for holding a cleaning mixture of the cleaning chemical and a diluting fluid. The cleaning system also includes a fluid supply conduit in fluid communication with a cleaning location and the tank. The valve may be located between the fluid supply conduit and the tank. The cleaning system also includes a fluid return conduit in fluid communication with the cleaning location and the tank, and a source of rinsing fluid in fluid communication with the fluid supply conduit and the fluid return conduit. The rinsing fluid has a predetermined concentration different from the cleaning mixture concentration. For instance, conductivity or pH may be used as the measure of concentration.

In this method according to the invention, a concentration sensor is located in the fluid supply conduit or the fluid return conduit. The sensor outputs concentration signals indicative of a concentration of a component of fluid passing the sensor. The processor of the controller is in communication with the sensor and the data storage means. During a period of operation of the cleaning system, the controller records in a data table time intervals during the period of operation of the cleaning system and concentration values associated with each of the time intervals. The concentration values are derived by the processor from concentration signals received from the sensor. The data is analyzed by comparing concentration values recorded during a time period in which rinsing fluid is passed through the fluid supply conduit or the fluid return conduit to the predetermined concentration. For example, during rinsing, if pH readings were used as the measure of concentration, the pH values should be at the predetermined pH of the rinsing fluid (e.g., 7.0 for water). When pH values recorded during the time period in which rinsing fluid is passed through the fluid supply conduit or the fluid return conduit are greater than or less than the predetermined pH, leaking of the valve is indicated. In other words, leaking of chemical from the tank alters the expected pH of the rinsing fluid which provides the indication of valve leakage.

It is thus an advantage of the present invention to provide a device and methods for controlling and recording chemical concentrations in a clean-in-place system where the device outputs data that can be used to diagnose overuse of cleaning chemicals.

It is another advantage of the present invention to provide a device and methods for controlling and recording chemical concentrations in a clean-in-place system where the device outputs data that can be used to diagnose clean-in-place system fluid flow problems such as leaking valves.

It is yet another advantage of the present invention to provide a device and methods for controlling and recording chemical concentrations in a clean-in-place system where the device outputs data that can be used to save on the water costs of the clean-in-place system.

It is still another advantage of the present invention to provide a device and methods for controlling and recording chemical concentrations in a clean-in-place system where the device outputs data that can provide evidence of cleaning in conformity with government regulations such as those promulgated by the USDA and the FDA.

It is yet another advantage of the present invention to provide a device and methods for controlling and recording chemical concentrations in a clean-in-place system where the device may feed one or more chemicals to one or more reservoirs for a user adjustable time period.

It is still another advantage of the present invention to provide a device and methods for controlling and recording chemical concentrations in a clean-in-place system where the device may feed one or more chemicals to one or more reservoirs until a user adjustable concentration set point is obtained.

These and other features, aspects, and advantages of the present invention will become better understood upon consideration of the following detailed description, appended claims and accompanying drawings.

BRIEF DESCRIPTION OF THE DRAWINGS

Like reference numerals will be used to refer to like or similar parts from Figure to Figure in the following description of the drawings.

DETAILED DESCRIPTION OF THE INVENTION

Figure 1:
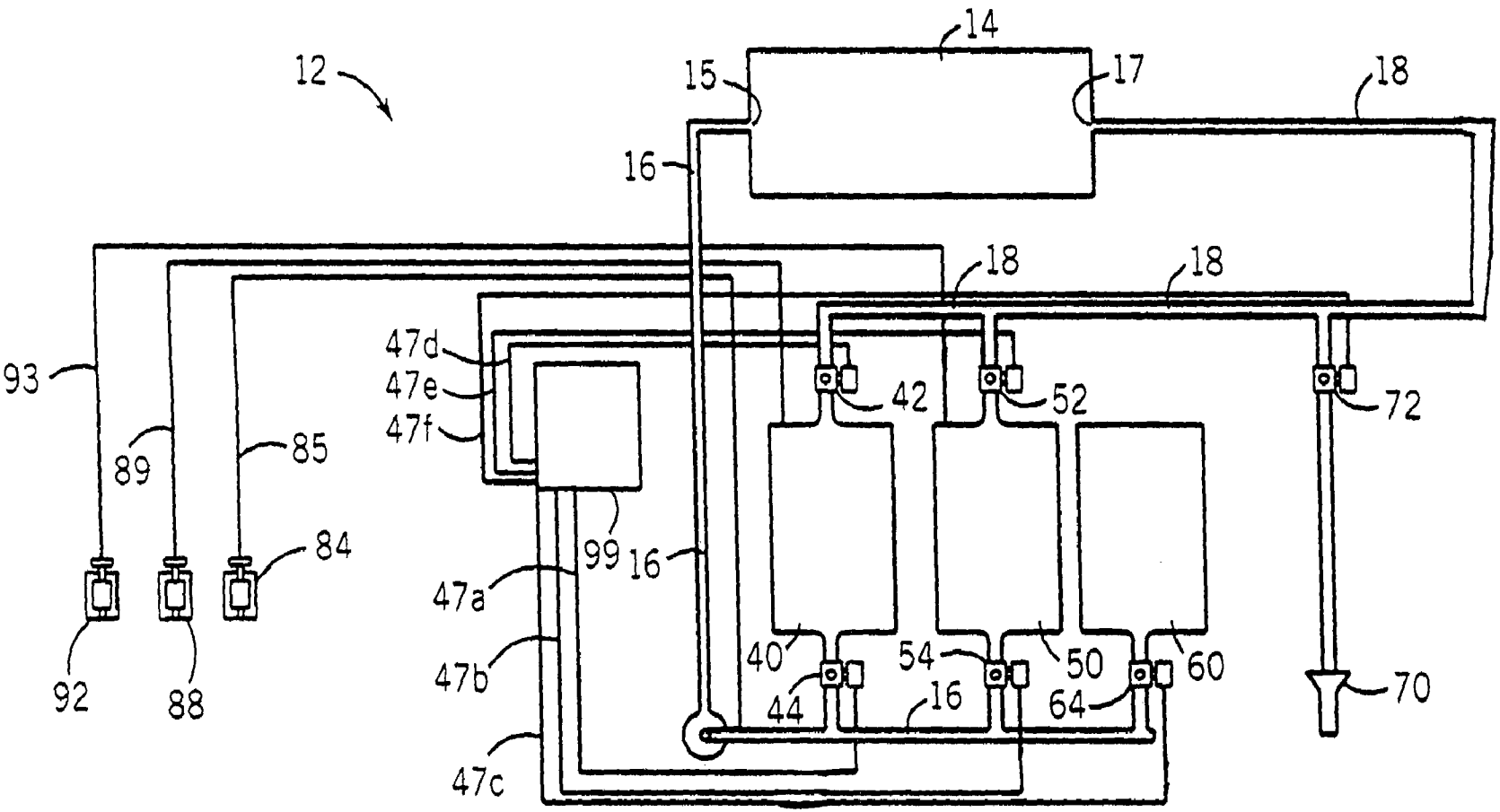
FIG. 1 PRIOR ART
FIG. 1 is a schematic of one version of a conventional clean-in-place system.

In order to provide background for the present invention, the arrangement and operation of one version of a conventional clean-in-place system will be described with reference to FIG. 1. The clean-in-place system, indicated generally at 12, is used to clean an apparatus, indicated generally at 14. The apparatus 14 may be, for example, food processing equipment, such as that found in dairies, breweries, and carbonated beverage plants, which typically includes tanks, pumps, valves and fluid piping. The apparatus 14 to be cleaned by the clean-in-place system 12 is not limited to this type of equipment but may be any apparatus that can be cleaned by moving fluids through the apparatus.

The clean-in-place system 12 includes an alkaline tank 40, an acid tank 50, and a rinse tank 60. The alkaline tank 40 typically contains an alkaline cleaning solution used in the clean-in-place process, and suitable alkaline cleaning solutions are well known and commercially available. The acid tank 50 typically contains an acidic cleaning solution used in the clean-in-place process, and suitable acidic cleaning solutions are well known and commercially available. The rinse tank 60 contains a rinsing composition used in the clean-in-place process, and in many clean-in-place systems, the rinsing composition is water.

The alkaline tank 40, the acid tank 50 and the rinse tank 60 are placed in fluid communication in the clean-in-place system 12 and with the apparatus 14 by way of various conduits and valves. The clean-in-place system 12 includes a fluid supply conduit 16 that is connected to an inlet 15 of the apparatus 14. The fluid supply conduit 16 of the clean-in-place system 10 is also connected to the alkaline tank 40, the acid tank 50 and the rinse tank 60 through an alkaline supply valve 44, an acid supply valve 54 and a rinse supply valve 64, respectively. The fluid supply conduit 16 of the clean-in-place system 10 is also connected to a sanitizer pump 84 by way of a sanitizer conduit 85. The sanitizer pump 84 provides a sanitizing composition to the fluid supply conduit 16 as described below.

The clean-in-place system 12 also includes a fluid return conduit 18 that is connected to an outlet 17 of the apparatus 14. The fluid return conduit 18 of the clean-in-place system 10 is also connected to the alkaline tank 40 and the acid tank 50 through an alkaline return valve 42 and an acid return valve 52, respectively. The fluid return conduit 18 of the clean-in-place system 12 is also connected to a clean-in-place system drain 70. A drain valve 72 is provided to control fluid flow from the fluid return conduit 18 of the clean-in-place system 12 to the drain 70.

The clean-in-place system 12 also includes an alkaline pump 88 that provides alkaline cleaning solution to the alkaline tank 40 by way of an alkaline conduit 89. An acid pump 92 is also provided to pump acidic cleaning solution to the acid tank 50 by way of an acid conduit 93. The valves of the clean-in-place system 12 are actuated using compressed air by way of control signals provided by lines 47*a*, 47*b*, 47*c*, 47*d*, 47*e*, and 47*f* to the valves from a programmable logic controller (PLC) 99. Such programmable logic controllers are commercially available from Rockwell Automation, Milwaukee, Wis.

Having described the construction of the clean-in-place system 12, the operation of the clean-in-place system 12 can now be described. After the apparatus 14 has completed one or more processes (such as a batch fluid packaging process), the clean-in-place system 12 is activated to clean and/or disinfect the apparatus 14. In a first step of the clean-in-place process, often termed the "first rinse" step, the rinse supply valve 64 is opened and the drain valve 72 is opened to allow rinse water (and often some suspended or dissolved solids) to be pushed from the apparatus 14 into the drain 70 by way of rinse water. In a next step called a "rinse push", the alkaline supply valve 44 is opened, the alkaline return valve 42 remains closed, and the drain valve 72 remains open, thereby pushing further amounts of the rinse water into the drain 70 by way of the alkaline cleaning solution from the alkaline tank 40.

In a following "alkaline wash" step, the alkaline supply valve 44 remains open, the alkaline return valve 42 is opened, and the drain valve 72 is closed such that alkaline cleaning solution is circulated and recirculated through the clean-in-place system 12 and the apparatus 14. Various compositions are suitable as the alkaline cleaning solution, and typically these alkaline solutions react with fatty acids in organic soils in the apparatus 14 to produce a salt by way of an acid-base reaction.

In a next step called "alkaline rinse push", the rinse supply valve 64 is opened, the alkaline return valve 42 remains open, and the alkaline supply valve 44 is closed, thereby pushing the alkaline cleaning solution in the clean-in-place system 12 and the apparatus 14 into the alkaline tank 40. In a subsequent step called "alkaline rinse", the rinse supply valve 64 remains open, and the drain valve 72 is opened, thereby sending rinse water (and suspended or dissolved solids) to the drain 70. In a following step called "rinse push", the rinse supply valve 64 is closed, the acid supply valve 54 is opened, the acid return valve 52 remains closed and the drain valve 72 remains open, thereby pushing further rinse water (and suspended or dissolved solids) to drain 70.

In a following "acid wash" step, the acid supply valve 54 remains open, the acid return valve 52 is opened, and the drain valve 72 is closed such that acidic cleaning solution is circulated and recirculated through the clean-in-place system 12 and the apparatus 14. Various compositions are suitable as the acidic cleaning solution, and typically these acidic solutions react with basic materials (e.g., minerals) in the apparatus 14 to produce a salt by way of an acid-base reaction.

In a next step called "acid rinse push", the rinse supply valve 64 is opened, the acid return valve 52 remains open, and the acid supply valve 54 is closed, thereby pushing the acidic cleaning solution in the clean-in-place system 12 and the apparatus 14 into the acid tank 50. In a following step called "acid rinse", the rinse supply valve 64 remains open, the acid return valve 52 is closed, and the drain valve 72 is opened, thereby sending rinse water (and suspended or dissolved solids) to the drain 70.

In a following step called "sanitize", the rinse supply valve 64 remains open, the drain valve 72 remains open, and the PLC initiates delivery of sanitizer from the sanitizer pump 84 by way of the sanitizer conduit 85 to the fluid supply conduit 16. The rinse water including the injected sanitizer is circulated through the clean-in-place system 12 and the apparatus 14, and is sent to drain 70. In a next step called "sanitizer push", sanitizer injected is stopped, the rinse supply valve 64 remains open and the drain valve 72 remains open thereby pushing the remaining sanitizer/water mixture to drain 70. The clean-in-place process is then complete.

It should be understood that the arrangement and operation of the clean-in-place system of FIG. 1 have been described for background context for the present invention. Numerous modifications of the clean-in-place system of FIG. 1 are possible. Several non-limiting examples of modifications of the clean-in-place system of FIG. 1 include: (1) a clean-in-place system having either an alkaline tank 40 or an acid tank 50; and (2) the clean-in-place system of FIG. 1 wherein various fluid "pushing" processes (e.g., "alkaline rinse push" or "acid rinse push") are executed by way of air from the air source rather than liquids from the alkaline tank 40, the acid tank 50, and/or the rinse tank 60.

Having described the construction and operation of the conventional clean-in-place system 12 shown in FIG. 1, some drawbacks and disadvantages of such a conventional clean-in-place system can be highlighted. Typically, devices are provided in such clean-in-place systems for the automatic dispensing of alkaline and acid chemicals to the alkaline tank and the acid tank of the clean-in-place system to provide for more efficient use of cleaning chemicals. For instance, the overuse of a cleaning chemical can be avoided by measuring the concentration of a cleaning chemical in the alkaline tank or acid tank with a conductivity probe and only adding enough cleaning chemical to keep the tank cleaning solutions at a predetermined concentration. However, conductivity probes can by fouled over time by chemical build-up thereby providing false indications of the water conductivity. Also, conductivity probes can fail thereby providing no indication of the water conductivity. Systems with fouled or nonfunctioning probes lead to overuse of a cleaning chemical. Also, known devices for monitoring clean-in-place system wash conditions may provide for more efficient operation of a clean-in-place system. However, these devices may not be suitable for diagnosing clean-in-place system fluid flow problems such as leaking valves.

Figure 2:
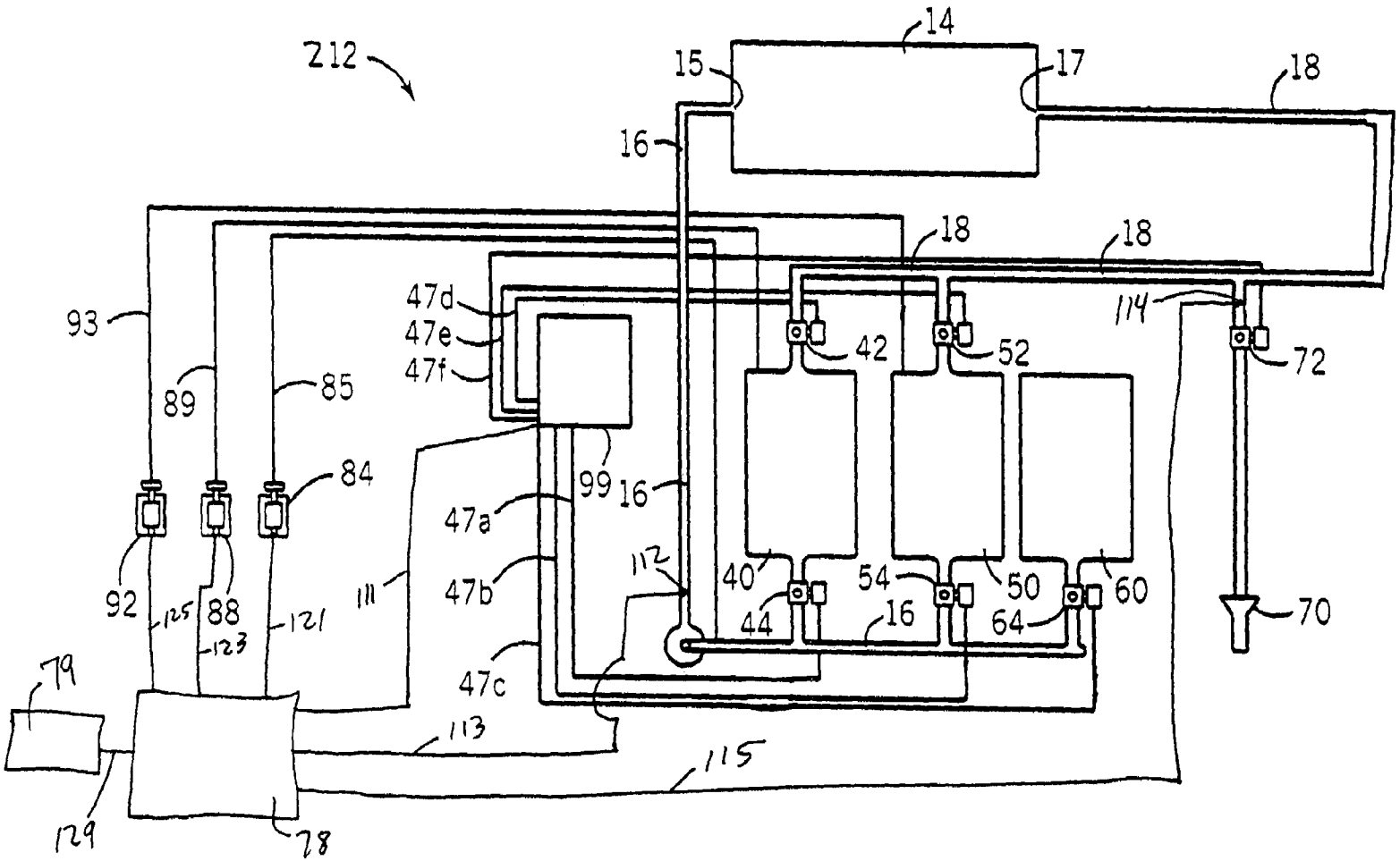
FIG. 2 is a schematic of a clean-in-place system including one embodiment of a chemical concentration controller and recorder in accordance with the invention.

Referring now to FIG. 2, there is shown one solution to these problems. Specifically, a schematic of a clean-in-place system according to the invention, indicated generally at 212, is shown. The clean-in-place system 212 of FIG. 2 includes many of the components of the clean-in-place system of FIG. 1. The clean-in-place system 212 of FIG. 2 includes an alkaline tank 40, an acid tank 50, and a rinse tank 60. The alkaline tank 40 typically contains an alkaline cleaning solution used in the clean-in-place process, and the acid tank 50 typically contains an acidic cleaning solution used in the clean-in-place process. The rinse tank 60 contains a rinsing composition used in the clean-in-place process, and in one embodiment, the rinsing composition is water. The alkaline tank 40, the acid tank 50 and the rinse tank 60 are placed in fluid communication in the clean-in-place system 212 and with the apparatus 14 by way of various conduits and valves. The clean-in-place system 212 includes a fluid supply conduit 16 that is connected to the inlet 15 of the apparatus 14. The fluid supply conduit 16 of the clean-in-place system 212 is also connected to the alkaline tank 40, the acid tank 50 and the rinse tank 60 through an alkaline supply valve 44, an acid supply valve 54 and a rinse supply valve 64, respectively. The fluid supply conduit 16 of the clean-in-place system 212 is also connected to a sanitizer pump 84 by way of a sanitizer conduit 85. The sanitizer pump 84 provides a sanitizing composition to the fluid supply conduit 16.

The clean-in-place system 212 also includes a fluid return conduit 18 that is connected to the outlet 17 of the apparatus 14. The fluid return conduit 18 of the clean-in-place system 212 is also connected to the alkaline tank 40, and the acid tank 50 through an alkaline return valve 42 and an acid return valve 52. The fluid return conduit 18 of the clean-in-place system 212 is also connected to a clean-in-place system drain 70. A drain valve 72 is provided to control fluid flow from the fluid return conduit 18 of the clean-in-place system 212 to the drain 70.

The clean-in-place system 212 also includes an alkaline pump 88 that provides alkaline cleaning solution to the alkaline tank 40 by way of an alkaline conduit 89. An acid pump 92 is also provided to pump acidic cleaning solution to the acid tank 50 by way of an acid conduit 93. The valves of the clean-in-place system 212 are actuated using compressed air by way of control signals provided by lines 47*a*, 47*b*, 47*c*, 47*d*, 47*e*, and 47*f* to the valves from a programmable logic controller 99. Fluid flow in the clean-in-place system 12 may be controlled by the programmable logic controller 99 using the "first rinse", "rinse push", "alkaline wash", "alkaline rinse push", "alkaline rinse", "rinse push", "acid wash", "acid rinse push", and "sanitize" operation steps described above with reference to FIG. 1.

The clean-in-place system 212 of FIG. 2 further includes a chemical controller 78 that is interfaced with the programmable logic controller 99 via line 111. A conductivity sensor 112 is also provided in fluid supply conduit 16 between the inlet 15 of the apparatus 14 and the alkaline tank 40. The conductivity sensor 112 is in electrical communication with the chemical controller 78 via line 113. A conductivity sensor 114 is also provided in the fluid return conduit 18 between the outlet 17 of the apparatus 14 and the drain valve 72. The conductivity sensor 114 is in electrical communication with the chemical controller 78 via line 115. Conductivity sensors are well known and commercially available. Alternatively, the conductivity sensors could be replaced by pH sensors or any other sensors that can measure the concentration of a component in a fluid.

The chemical controller 78 is also is in electrical communication with the acid pump 92 via line 125. The chemical controller 78 is also is in electrical communication with the alkaline pump 88 via line 123. The chemical controller 78 is also is in electrical communication with the sanitizer pump 84 via line 121. The chemical controller 78 provides on and off electrical signals via lines 121, 123, 125 to the sanitizer pump 84, the alkaline pump 88, and the acid pump 92 respectively.

The chemical controller 78 includes a processor running stored software and conventional data storage means (e.g., disk or digital memory) for recording signals received by the processor from the conductivity sensor 112 and the conductivity sensor 114 as a function of time and for recording on and off signals provided to the sanitizer pump 84, the alkaline pump 88, and the acid pump 92 as a function of time. The stored data may be viewed or printed out using well known data processing techniques. The data may be downloaded from the data storage means of the chemical controller 78 to a laptop computer 79 via communication line 129. Alternatively, data may be downloaded from the data storage means of the chemical controller 78 via infrared transmission to other mobile computer technology such as a commercially available wireless palm computer, i.e., a Personal Digital Assistant (PDA).

Having described the construction of the clean-in-place system 212 of FIG. 2, the operation of the clean-in-place system 212 can now be described. After the apparatus 14 has completed one or more processes (such as a batch fluid packaging process), the clean-in-place system 212 is activated to clean and/or disinfect the apparatus 14. Fluid flow in the clean-in-place system 212 may be controlled by the programmable logic controller 99 using the "first rinse", "rinse push", "alkaline wash", "alkaline rinse push", "alkaline rinse", "rinse push", "acid wash", "acid rinse push", and "sanitize" operation steps described above with reference to FIG. 1.

During the clean-in-place process, the chemical controller 78 records concentration signals received from the conductivity sensor 112 and the conductivity sensor 114 as a function of time, and records the activation ("on") signals and deactivation ("off") signals of the sanitizer pump 84, the alkaline pump 88 and the acid pump 92 as a function of time. After one or more cleaning cycles of the clean-in-place process, the data stored in the chemical controller 78 may be downloaded to the lap top computer 79 or to a wireless PDA and printed and analyzed. The data may be analyzed by the user or by software in the computer or controller. The data provides as a function of time: (1) the measured conductivity (or measured pH if pH sensors are used) for the fluid in the fluid supply conduit 16 as measured when the fluid passes the conductivity sensor 112; (2) the measured conductivity (or measured pH if pH sensors are used) for the fluid in the fluid return conduit 18 as measured when the fluid passes the conductivity sensor 114; and (3) the activation and deactivation of the sanitizer pump 84, the alkaline pump 88 and the acid pump 92. An example data table is shown as Table 1 where pH sensors are used. Table 1 is presented for the purpose of illustration only and does not limit the invention in any way. For example, sensors 112 and 114 may provide conductivity readings for the table or any other indication of the concentration of a component in a fluid.

TABLE 1

| Date | Time | Sensor 112 (pH) | Sensor 114 (pH) | Sanitizer Pump | Alkaline Pump | Acid Pump |
|---|---|---|---|---|---|---|
| Apr. 01, 2004 | 1:00:00 | 7 | 7 | Off | Off | Off |
| Apr. 01, 2004 | 1:00:10 | 7 | 7 | Off | Off | Off |
| Apr. 01, 2004 | 1:00:20 | 7 | 7 | Off | Off | Off |
| Apr. 01, 2004 | 1:00:30 | 7 | 7 | Off | Off | Off |
| Apr. 01, 2004 | 1:00:40 | 7 | 7 | Off | Off | Off |
| Apr. 01, 2004 | 1:00:50 | 7 | 7 | Off | Off | Off |
| Apr. 01, 2004 | 1:01:00 | 9 | 7 | Off | Off | Off |
| Apr. 01, 2004 | 1:01:10 | 9 | 7 | Off | Off | Off |
| Apr. 01, 2004 | 1:01:20 | 9 | 9 | Off | On | Off |
| Apr. 01, 2004 | 1:01:30 | 9 | 9 | Off | On | Off |
| Apr. 01, 2004 | 1:01:40 | 9 | 9 | Off | On | Off |
| Apr. 01, 2004 | 1:01:50 | 9 | 9 | Off | On | Off |
| Apr. 01, 2004 | 1:02:00 | 9 | 9 | Off | On | Off |
| Apr. 01, 2004 | 1:02:10 | 9 | 9 | Off | On | Off |
| Apr. 01, 2004 | 1:02:20 | 7 | 9 | Off | On | Off |
| Apr. 01, 2004 | 1:02:30 | 7 | 9 | Off | On | Off |
| Apr. 01, 2004 | 1:02:40 | 7 | 7 | Off | On | Off |
| Apr. 01, 2004 | 1:02:50 | 7 | 7 | Off | On | Off |
| Apr. 01, 2004 | 1:03:00 | 7 | 7 | Off | On | Off |
| Apr. 01, 2004 | 1:03:10 | 7 | 7 | Off | Off | Off |
| Apr. 01, 2004 | 1:03:20 | 7 | 7 | Off | Off | Off |
| Apr. 01, 2004 | 1:03:30 | 7 | 7 | Off | Off | Off |
| Apr. 01, 2004 | 1:03:40 | 5 | 7 | Off | Off | Off |
| Apr. 01, 2004 | 1:03:50 | 5 | 7 | Off | Off | Off |
| Apr. 01, 2004 | 1:04:00 | 5 | 5 | Off | Off | On |
| Apr. 01, 2004 | 1:04:10 | 5 | 5 | Off | Off | On |
| Apr. 01, 2004 | 1:04:20 | 5 | 5 | Off | Off | On |
| Apr. 01, 2004 | 1:04:30 | 5 | 5 | Off | Off | On |
| Apr. 01, 2004 | 1:04:40 | 5 | 5 | Off | Off | On |
| Apr. 01, 2004 | 1:04:50 | 5 | 5 | Off | Off | Off |
| Apr. 01, 2004 | 1:05:00 | 7 | 5 | Off | Off | Off |
| Apr. 01, 2004 | 1:05:10 | 7 | 5 | On | Off | Off |
| Apr. 01, 2004 | 1:05:20 | 8 | 7 | On | Off | On |
| Apr. 01, 2004 | 1:05:30 | 8 | 7 | On | Off | On |
| Apr. 01, 2004 | 1:05:40 | 8 | 8 | On | Off | On |
| Apr. 01, 2004 | 1:05:50 | 7 | 8 | Off | Off | Off |

By analyzing the data table downloaded from the chemical controller 78 after one or more cleaning cycles of the clean-in-place process, subsequent cleaning cycles can be optimized. For example, when pH sensors are used, operation of the alkaline pump 88 should lead to an increase in the sensed pH during an alkaline wash after a time period of feed from the alkaline pump 88. This could be seen by an analysis of sensor 112 readings in a specific data table. The absence of a pH increase can provide an indication that various conduits or valves are leaking or that the conductivity sensor 112 is fouled or not providing feedback to the chemical controller 78. Likewise, operation of the acid pump 92 should lead to a decrease in the sensed pH during an acid wash after a time period of feed from the acid pump 92. This could be seen by an analysis of sensor 112 readings in a specific data table. The absence of a pH decrease can provide an indication that various conduits or valves are leaking or that the conductivity sensor 112 is fouled or not providing feedback to the chemical controller 78. Also, during a water rinse operation, the pH should return to 7.0. An analysis of sensor 114 readings that show a pH other than 7.0 during a rinse can provide an indication that alkaline supply valve 44 or acid supply valve 54 may be leaking alkaline or acid into the fluid supply conduit 16 during a rinse.

Figure 3:
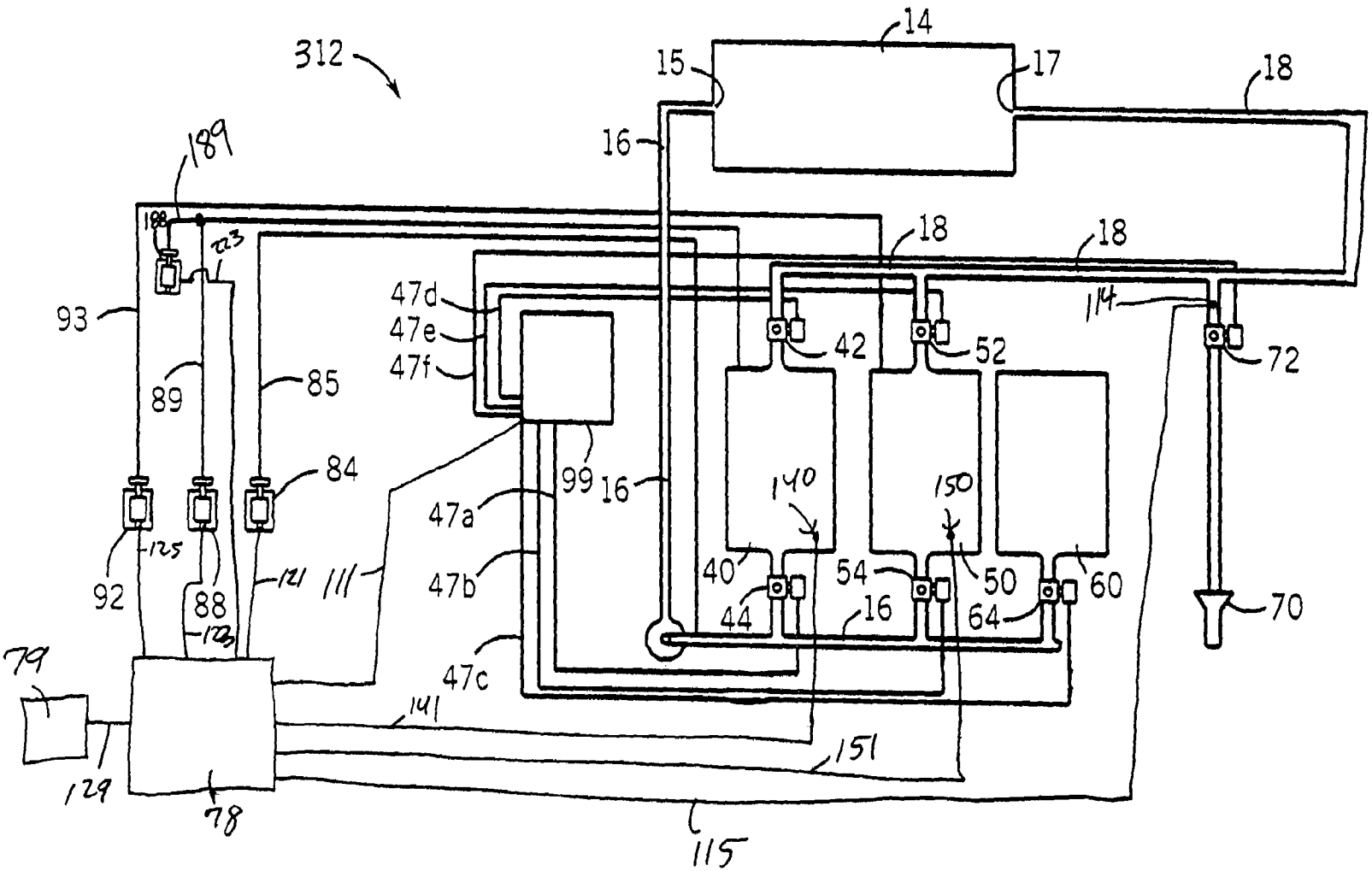
FIG. 3 is a schematic of a clean-in-place system including another embodiment of a chemical concentration controller and recorder in accordance with the invention.

Referring now to FIG. 3, a schematic of a clean-in-place system according to the invention, indicated generally at 312, is shown. This provides another solution to the aforementioned problems with clean-in-place systems. The clean-in-place system 312 of FIG. 3 includes many of the components of the clean-in-place system of FIG. 1. The clean-in-place system 312 of FIG. 3 includes an alkaline tank 40, an acid tank 50, and a rinse tank 60. The alkaline tank 40 typically contains an alkaline cleaning solution used in the clean-in-place process, and the acid tank 50 typically contains an acidic cleaning solution used in the clean-in-place process. The rinse tank 60 contains a rinsing composition used in the clean-in-place process, and in one embodiment, the rinsing composition is water. The alkaline tank 40, the acid tank 50 and the rinse tank 60 are placed in fluid communication in the clean-in-place system 312 and with the apparatus 14 by way of various conduits and valves. The clean-in-place system 312 includes a fluid supply conduit 16 that is connected to the inlet 15 of the apparatus 14. The fluid supply conduit 16 of the clean-in-place system 12 is also connected to the alkaline tank 40, the acid tank 50 and the rinse tank 60 through an alkaline supply valve 44, an acid supply valve 54 and a rinse supply valve 64, respectively. The fluid supply conduit 16 of the clean-in-place system 312 is also connected to a sanitizer pump 84 by way of a sanitizer conduit 85. The sanitizer pump 84 provides a sanitizing composition to the fluid supply conduit 16.

The clean-in-place system 312 also includes a fluid return conduit 18 that is connected to the outlet 17 of the apparatus 14. The fluid return conduit 18 of the clean-in-place system 312 is also connected to the alkaline tank 40, and the acid tank 50 through an alkaline return valve 42 and an acid return valve 52. The fluid return conduit 18 of the clean-in-place system 312 is also connected to a clean-in-place system drain 70. A drain valve 72 is provided to control fluid flow from the fluid return conduit 18 of the clean-in-place system 312 to the drain 70.

The clean-in-place system 312 also includes an alkaline pump 88 that provides alkaline cleaning solution to the alkaline tank 40 by way of an alkaline conduit 89. The clean-in-place system 312 also includes an alkaline booster pump 188 that provides alkaline booster cleaning solution to the alkaline tank 40 by way of booster conduit 189 and alkaline conduit 89. An acid pump 92 is also provided to pump acidic cleaning solution to the acid tank 50 by way of an acid conduit 93. The valves of the clean-in-place system 312 are actuated using compressed air by way of control signals provided by lines 47*a*, 47*b*, 47*c*, 47*d*, 47*e*, and 47*f* to the valves from a programmable logic controller 99. Fluid flow in the clean-in-place system 312 may be controlled by the programmable logic controller 99 using the "first rinse", "rinse push", "alkaline wash", "alkaline rinse push", "alkaline rinse", "rinse push", "acid wash", "acid rinse push", and "sanitize" operation steps described above with reference to FIG. 1.

The clean-in-place system 312 of FIG. 3 further includes a chemical controller 78 that is interfaced with the programmable logic controller 99 via line 111. A conductivity sensor 140 is also provided in alkaline tank 40. The conductivity sensor 140 is in electrical communication with the chemical controller 78 via line 141. A conductivity sensor 150 is also provided in acid tank 50. The conductivity sensor 150 is in electrical communication with the chemical controller 78 via line 151. A conductivity sensor 114 is also provided in the fluid return conduit 18 between the outlet 17 of the apparatus 14 and the drain valve 72. The conductivity sensor 114 is in electrical communication with the chemical controller 78 via line 115. These conductivity sensors are well known and commercially available. Alternatively, the conductivity sensors could be replaced by pH sensors or any other sensors that can measure the concentration of a component in a fluid.

The chemical controller 78 is also is in electrical communication with the acid pump 92 via line 125. The chemical controller 78 is also is in electrical communication with the alkaline pump 88 via line 123. The chemical controller 78 is also is in electrical communication with the booster pump 188 via line 223. The chemical controller 78 is also is in electrical communication with the sanitizer pump 84 via line 121. The chemical controller 78 provides on and off electrical signals via lines 121, 123, 125, 223 to the sanitizer pump 84, the alkaline pump 88, the acid pump 92 and the booster pump 188, respectively.

The chemical controller 78 includes software and suitable data storage means for recording signals received from the conductivity sensor 140, the conductivity sensor 150 and the conductivity sensor 114 as a function of time and for recording on and off signals provided to the sanitizer pump 84, the alkaline pump 88, the acid pump 92 and the booster pump 188 as a function of time. The stored data may be viewed or printed out using well known data processing techniques. The data may be downloaded from the chemical controller 78 to a lap top computer 79 via communication line 129. Alternatively, data may be downloaded from the chemical controller 78 to a wireless PDA.

Having described the construction of the clean-in-place system 312 of FIG. 3, the operation of the clean-in-place system 312 can now be described. After the apparatus 14 has completed one or more processes (such as a batch fluid packaging process), the clean-in-place system 312 is activated to clean and/or disinfect the apparatus 14. Fluid flow in the clean-in-place system 312 may be controlled by the programmable logic controller 99 using the "first rinse", "rinse push", "alkaline wash", "alkaline rinse push", "alkaline rinse", "rinse push", "acid wash", "acid rinse push", and "sanitize" operation steps described above with reference to FIG. 1.

During the clean-in-place process, the chemical controller 78 records signals received from the conductivity sensor 140, the conductivity sensor 150 and the conductivity sensor 114 as a function of time, and records the activation ("on") signals and deactivation ("off") signals of the sanitizer pump 84, the alkaline pump 88, the acid pump 92, and the booster pump 188 as a function of time. After one or more cleaning cycles of the clean-in-place process, the data stored in the chemical controller 78 may be downloaded to the lap top computer 79 or to a wireless PDA and printed and analyzed. The data may be analyzed by the user or by software in the computer or controller. The data provides as a function of time: (1) the measured conductivity (or measured pH if pH sensors are used) for the fluid in the alkaline tank 40 as measured by the conductivity sensor 140; (2) the measured conductivity (or measured pH if pH sensors are used) for the fluid in the acid tank 50 as measured by the conductivity sensor 150; (3) the measured conductivity (or measured pH if pH sensors are used) for the fluid in the fluid return conduit 18 as measured when the fluid passes the conductivity sensor 114; and (4) the activation and deactivation of the sanitizer pump 84, the alkaline pump 88, the booster pump 188, the acid pump 92 and the booster pump 188. An example data table is shown as Table 2 where pH sensors are used. Table 2 is presented for the purpose of illustration only and does not limit the invention in any way. For example, sensors 140, 150 and 114 may provide conductivity readings for the table or any other indication of the concentration of a component in a fluid.

TABLE 2

| Date | Time | Sensor 140 (pH) | Sensor 150 (pH) | Sensor 114 (pH) | Sanitizer Pump | Alkaline Pump | Acid Pump |
|---|---|---|---|---|---|---|---|
| Apr. 01, 2004 | 2:00:00 | 9 | 5 | 7 | Off | Off | Off |
| Apr. 01, 2004 | 2:00:10 | 9 | 5 | 7 | Off | Off | Off |
| Apr. 01, 2004 | 2:00:20 | 9 | 5 | 7 | Off | Off | Off |
| Apr. 01, 2004 | 2:00:30 | 9 | 5 | 7 | Off | Off | Off |
| Apr. 01, 2004 | 2:00:40 | 9 | 5 | 7 | Off | Off | Off |
| Apr. 01, 2004 | 2:00:50 | 9 | 5 | 7 | Off | Off | Off |
| Apr. 01, 2004 | 2:01:00 | 9 | 5 | 7 | Off | Off | Off |
| Apr. 01, 2004 | 2:01:10 | 9 | 5 | 7 | Off | Off | Off |
| Apr. 01, 2004 | 2:01:20 | 9 | 5 | 9 | Off | On | Off |
| Apr. 01, 2004 | 2:01:30 | 9 | 5 | 9 | Off | On | Off |
| Apr. 01, 2004 | 2:01:40 | 8.8 | 5 | 9 | Off | On | Off |
| Apr. 01, 2004 | 2:01:50 | 8.6 | 5 | 9 | Off | On | Off |
| Apr. 01, 2004 | 2:02:00 | 8.4 | 5 | 9 | Off | On | Off |
| Apr. 01, 2004 | 2:02:10 | 8.2 | 5 | 9 | Off | On | Off |
| Apr. 01, 2004 | 2:02:20 | 8.4 | 5 | 9 | Off | On | Off |
| Apr. 01, 2004 | 2:02:30 | 8.6 | 5 | 9 | Off | On | Off |
| Apr. 01, 2004 | 2:02:40 | 8.8 | 5 | 7 | Off | On | Off |
| Apr. 01, 2004 | 2:02:50 | 9 | 5 | 7 | Off | On | Off |
| Apr. 01, 2004 | 2:03:00 | 9 | 5 | 7 | Off | On | Off |
| Apr. 01, 2004 | 2:03:10 | 9 | 5 | 7 | Off | Off | Off |
| Apr. 01, 2004 | 2:03:20 | 9 | 5 | 7 | Off | Off | Off |
| Apr. 01, 2004 | 2:03:30 | 9 | 5 | 7 | Off | Off | Off |
| Apr. 01, 2004 | 2:03:40 | 9 | 5 | 7 | Off | Off | Off |
| Apr. 01, 2004 | 2:03:50 | 9 | 5 | 7 | Off | Off | Off |
| Apr. 01, 2004 | 2:04:00 | 9 | 5.4 | 5 | Off | Off | On |
| Apr. 01, 2004 | 2:04:10 | 9 | 5.6 | 5 | Off | Off | On |
| Apr. 01, 2004 | 2:04:20 | 9 | 5.4 | 5 | Off | Off | On |
| Apr. 01, 2004 | 2:04:30 | 9 | 5.2 | 5 | Off | Off | On |
| Apr. 01, 2004 | 2:04:40 | 9 | 5 | 5 | Off | Off | On |
| Apr. 01, 2004 | 2:04:50 | 9 | 5 | 5 | Off | Off | Off |
| Apr. 01, 2004 | 2:05:00 | 9 | 5 | 5 | Off | Off | Off |
| Apr. 01, 2004 | 2:05:10 | 9 | 5 | 5 | On | Off | Off |
| Apr. 01, 2004 | 2:05:20 | 9 | 5 | 7 | On | Off | On |
| Apr. 01, 2004 | 2:05:30 | 9 | 5 | 7 | On | Off | On |
| Apr. 01, 2004 | 2:05:40 | 9 | 5 | 8 | On | Off | On |
| Apr. 01, 2004 | 2:05:50 | 9 | 5 | 8 | Off | Off | Off |

By analyzing the data table downloaded from the chemical controller 78 after one or more cleaning cycles of the clean-in-place process, subsequent cleaning cycles can be optimized. For example, when pH sensors are used, operation of the alkaline pump 88 should lead to an increase in the sensed pH in the alkaline tank 40 after a time period of feed from the alkaline pump 88. This could be seen by an analysis of sensor 140 readings in a specific data table. The absence of a pH increase can provide an indication that various conduits or valves are leaking or that the conductivity sensor 140 is fouled or not providing feedback to the chemical controller 78. Likewise, operation of the acid pump 92 should lead to a decrease in the sensed pH in the acid tank 50 after a time period of feed from the acid pump 92. This could be seen by an analysis of sensor 150 readings in a specific data table. The absence of a pH decrease can provide an indication that various conduits or valves are leaking or that the conductivity sensor 150 is fouled or not providing feedback to the chemical controller 78. Also, during a water rinse operation, the pH should return to 7.0. An analysis of sensor 114 readings that show a pH other than 7.0 during a rinse can provide an indication that alkaline supply valve 44 or acid supply valve 54 may be leaking alkaline or acidic chemicals into the fluid supply conduit 16 during a rinse.

Figure 4:
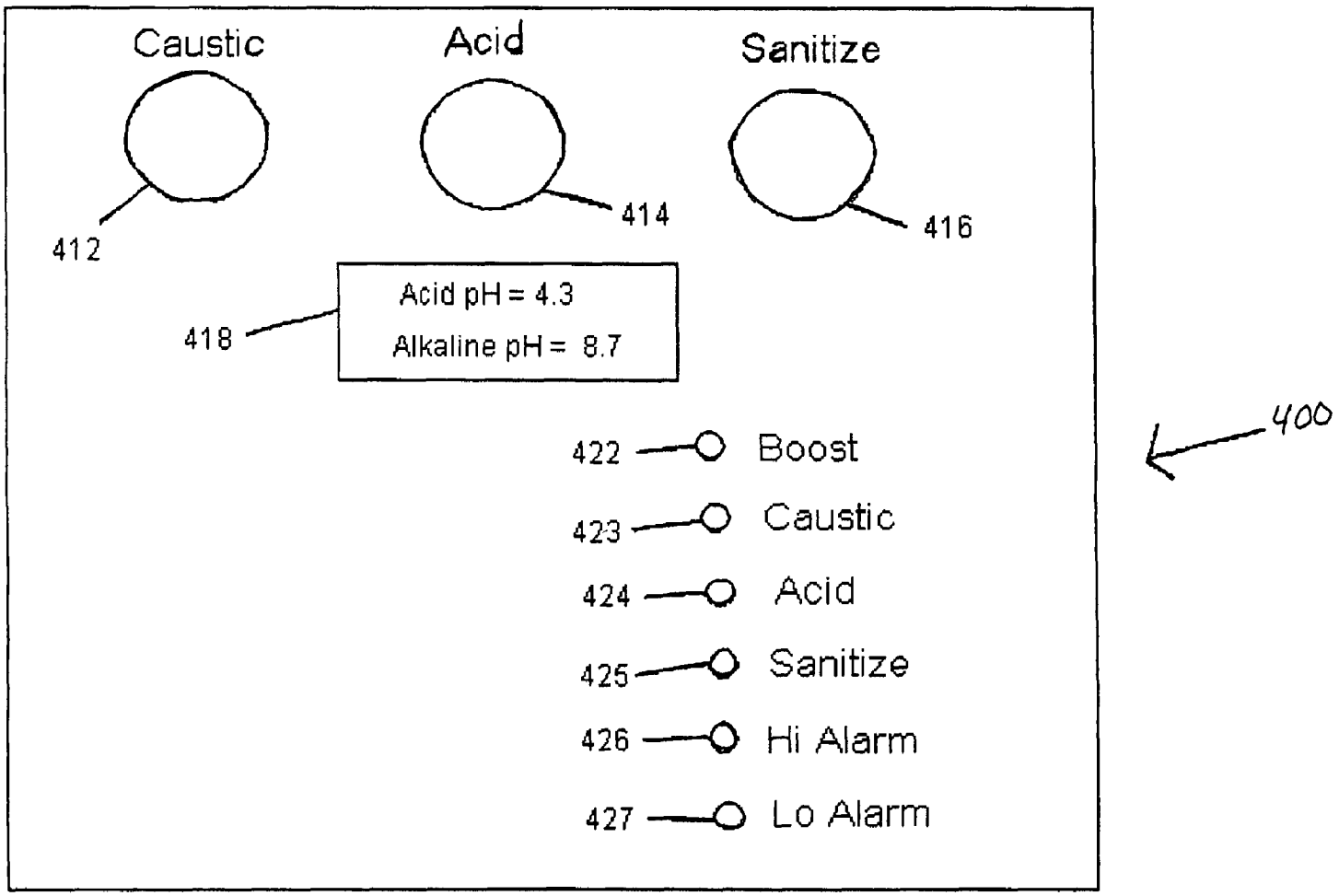
FIG. 4 shows a front panel of one embodiment of a chemical concentration controller and recorder in accordance with the invention.

Turning now to FIG. 4, there is shown a front panel 400 of one embodiment of a chemical concentration controller and recorder in accordance with the invention. The front panel 400 includes a caustic (alkaline) feed push button 412, an acid feed push button 414 and a sanitize feed push button 416. During maintenance of the clean-in-place system 212 and 312, the alkaline tank 40 and the acid tank 50 may be drained of solution. Water is then added to the alkaline tank 40 and the acid tank 50. By pressing the caustic (alkaline) feed push button 412, feed of alkaline chemical is started from the alkaline pump 88 into the water in the alkaline tank 40. Likewise, feed of acidic chemical from the acid pump 92 is started into the water in the acid tank 50 by pressing acid feed push button 414.

The feed of alkaline and acidic chemicals continues until the alkaline tank 40 concentration increases or decreases to a preset concentration (e.g., a preset pH or a preset conductivity) as measured by the concentration sensor 140 in the alkaline tank 40, and the acid tank 50 concentration decreases or increases to a preset concentration (e.g., a preset pH or a preset conductivity) as measured by the concentration sensor 150 in the acid tank 50. This may be termed "concentration feed". The alkaline and acid concentration preset levels are programmed in the processor of the chemical concentration controller and recorder by way of laptop computer 79 via communication line 129 as shown in FIG. 3.

Alternatively, the processor of the chemical concentration controller and recorder can be programmed by laptop computer 79 to feed chemicals from the alkaline pump 88 and the acid pump 92 for a set period of time ("timed feed"). The length of this "timed feed" can be preset in the processor of the chemical concentration controller independently for the alkaline pump 88 and the acid pump 92. Thus, both concentration feed and timed feed are available and can be programmed in the chemical concentration controller and recorder by way of laptop computer 79. Also, the chemical concentration controller and recorder can be programmed such that feed of alkaline chemical is started from the alkaline pump 88 and feed of alkaline booster cleaning solution is also started from alkaline booster pump 188 into the water in the alkaline tank 40. This provides a "charge and boost" function for filling the alkaline tank 40.

The caustic (alkaline) feed push button 412, the acid feed push button 414 and the sanitize feed push button 416 also include indicator lights that turn on during operation of the alkaline pump 88, the acid pump 92 and the sanitizer pump 84, respectively. For example, during operation of the clean-in-place system 312 of FIG. 3, the chemical concentration controller and recorder will signal the alkaline pump 88, the acid pump 92 and the sanitizer pump 84 to turn on at various times. When the alkaline pump 88, the acid pump 92 and the sanitizer pump 84 are activated, the lights of the caustic (alkaline) feed push button 412, the acid feed push button 414 and the sanitize feed push button 416 will light accordingly. The chemical concentration controller and recorder can control the alkaline pump 88, the acid pump 92 and the sanitizer pump 84 during operation of the clean-in-place system 312 of FIG. 3 using concentration feed or timed feed as described above. In one form, timed feed during operation of the clean-in-place system 312 of FIG. 3 will light the caustic (alkaline) feed push button 412, the acid feed push button 414 and the sanitize feed push button 416.

The front panel 400 of the chemical concentration controller and recorder includes a digital LED display for visual read out of the alkaline tank 40 concentration and the acid tank 50 concentration. For example, the LED display provides visual read out of values that relate to the pH or the conductivity of the solution in alkaline tank 40 and acid tank 50. The front panel 400 of the chemical concentration controller and recorder also includes an array of light emitting diodes 422, 423, 424, 425, 426 and 427, labeled Boost, Caustic, Acid, Sanitize, Hi Alarm, and Lo Alarm respectively, on the front panel 400. The Boost light emitting diode 422 indicates that alkaline booster pump 188 is activated to provide alkaline booster cleaning solution to the alkaline tank 40. The Caustic light emitting diode 423 indicates that alkaline pump 88 is activated to provide alkaline cleaning solution to the alkaline tank 40. The Acid light emitting diode 424 indicates that acid pump 92 is activated to provide acid to the acid tank 50. The Sanitize light emitting diode 425 indicates that sanitizer pump 84 is activated to provide sanitizer to the fluid supply conduit 16. The Hi Alarm light emitting diode 426 indicates during operation of the alkaline pump 88 that the pH of the alkaline tank 40 has exceeded a preset pH level. The Lo Alarm light emitting diode 422 indicates during operation of the acid pump 92 that the pH of the acid tank 50 has fallen below a preset pH level. Alternatively, the Hi Alarm light emitting diode 426 indicates during operation of the alkaline pump 88 that the conductivity of the alkaline tank 40 has exceeded a preset conductivity level, and the Lo Alarm light emitting diode 422 indicates during operation of the acid pump 92 that the conductivity of the acid tank 50 has exceeded a preset conductivity level. The Hi Alarm light emitting diode 426 and the Lo Alarm light emitting diode 422 may be supplemented with audible alarms. This allows a user to avoid overfeeding the alkaline tank 40 and the acid tank 50.

Without intending to limit the invention, one embodiment of a chemical concentration controller and recorder in accordance with the invention has the following specifications: Electrical Requirements—120V AC; Controller Options—Dual conductivity probes or timed feed; Data Storage—32K bytes (approx. 300 cycles, 30 minutes each); Connection to clean-in-place PLC—18 conductor cable, six foot length; External inputs from clean-in-place PLC—Acid cycle, Alkaline cycle, Sanitize cycle; System Outputs—6 outputs; 3 to pumps, 2 to alarms, 1 spare; LED Display—4½ digit, 7 segment character, 4 second data recycle; System Programming—Via laptop and RS 485 serial connection; Data Downloading—Via infrared transmission to palm computer; Panel Specifications—NEMA 4 rating; and Panel Dimensions—8" wide×8" high×5" deep.

Thus, there has been provided a device and methods for controlling and recording chemical concentrations in a clean-in-place system or similar automated washer. While the invention has been described in the context of a clean-in-place system, it may be applied in other cleaning systems such as warewashers, central foam systems, tunnel washers, COP tanks, egg washers, membrane cleaning systems, form washers, case washers and the like.

The chemical concentration controller and recorder has many features including, without limitation: (i) the chemical concentration controller and recorder maintains proper concentration; (ii) the digital L.E.D. display provides visual readout thereby reducing testing; (iii) the chemical concentration controller and recorder has one or multiple sensor probe capability for easy control of chemical usage; (iv) the chemical concentration controller and recorder uses a personal computer set-up for easy set-up for concentration, alarm levels and records; (v) the digital concentration set-points allow for tighter control; (vi) the chemical concentration controller and recorder controls concentration by concentration or time providing two types of chemical feed in one unit; (vii) the high-low alarm settings eliminates over feeding; (viii) the chemical concentration controller and recorder records conductivity per cycle providing historical data for cost control; (ix) the chemical concentration controller and recorder records time of feed pump operation which allows for review of feed pump runtimes to monitor usage; (x) the chemical concentration controller and recorder uses personal computer or infrared download of data such that data can be downloaded to a personal computer or Palm held PDA for data analysis; (xi) the chemical concentration controller and recorder provides a charge and boost function to recharge tanks or feed additives; and (xii) the chemical concentration controller and recorder uses a 110 volt, NEMA 4 cabinet that can be just plugged in an electrical outlet and that is water resistant.

Although the present invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

What is claimed is:

1. A control system for a cleaning system including a pump for supplying a cleaning chemical to a tank for holding a cleaning mixture of the cleaning chemical and a diluting fluid, the cleaning system further including a fluid supply conduit in fluid communication with a cleaning location and the tank, the cleaning system further including a fluid return conduit in fluid communication with the cleaning location and the tank, the cleaning system further including a source of rinsing fluid in fluid communication with the cleaning location, the cleaning system further including a drain in fluid communication with the cleaning location, the control system comprising:

a sensor located in the fluid supply conduit, the sensor outputting concentration signals indicative of a concentration of a component of fluid passing the sensor; and a controller having a processor and a data storage means, the processor being in communication with the sensor and the data storage means, wherein the controller is configured to executed a program stored in the controller to:

record in the data storage means a data table including (i) time intervals during a period of operation of the cleaning system, and (ii) concentration values associated with each of the time intervals, the concentration values being derived by the processor from concentration signals received from the sensor.

2. The control system of claim 1 wherein:

the processor is also in communication with the pump for providing on signals and off signals to the pump for turning on and turning off the pump, and the controller also records in the data table pump operating status values associated with each of the time intervals, the pump operating status values being indicative of the on signals and the off signals provided by the processor to the pump.

3. The control system of claim 1 wherein:

the control system further comprises a second sensor located in a fluid path between the cleaning location and the drain, the second sensor outputting second concentration signals indicative of a concentration of a component of fluid passing the second sensor, and the controller also records in the data table second concentration values associated with each of the time intervals, the second concentration values being derived by the processor from second concentration signals received from the second sensor.

4. The control system of claim 1 wherein:

the cleaning system further includes a second pump for supplying a second cleaning chemical to a second tank for holding a second cleaning mixture of the second cleaning chemical and a second diluting fluid, the second tank being in fluid communication with the fluid supply conduit and the fluid return conduit, and the processor is also in communication with the second pump for providing on signals and off signals to the second pump for turning on and turning off the second pump, and the controller also records in the data table second pump operating status values associated with each of the time intervals, the second pump operating status values being indicative of the on signals and the off signals provided by the processor to the second pump.

5. The control system of claim 1 wherein:

the processor is also in communication with the pump for providing on signals and off signals to the pump for turning on and turning off the pump, and the controller executes the program stored in the controller to provide an off signal to the pump at a predetermined time period after an on signal is provided to the pump.

6. The control system of claim 5 wherein:

the predetermined time period can be modified in the program using the processor.

7. The control system of claim 5 wherein:

the controller includes an activation button to provide the on signal to the pump.

8. The control system of claim 1 wherein:

the processor is also in communication with the pump for providing on signals and off signals to the pump for turning on and turning off the pump, and the controller executes the program stored in the controller to provide an off signal to the pump when the sensor outputs a concentration signal of a predetermined concentration value after an on signal is provided to the pump.

9. The control system of claim 8 wherein:

the predetermined concentration value can be modified in the program using the processor.

10. The control system of claim 8 wherein:

the controller executes the program stored in the controller to provide an alarm signal if the sensor outputs a concentration signal indicating a concentration of a component that goes above or below the predetermined concentration value.

11. The control system of claim 8 wherein:

the controller includes an activation button to provide the on signal to the pump.

12. The control system of claim 1 wherein:

the controller executes the program to download the data table via an interface to a computer or wirelessly transmit the data table to a computer.

13. The control system of claim 1 wherein:

the cleaning system further includes a second pump for supplying a second cleaning chemical to the tank, and the processor is also in communication with the second pump for providing on signals and off signals to the second pump for turning on and turning off the second pump, and the controller includes an activation button to provide on signals to the pump and the second pump.

14. The control system of claim 1 wherein:

the controller further includes a display for outputting concentration of fluid passing the sensor.

15. A control system for a cleaning system including a pump for supplying a cleaning chemical to a tank for holding a cleaning mixture of the cleaning chemical and a diluting fluid, the cleaning system further including a fluid supply conduit in fluid communication with a cleaning location and the tank, the cleaning system further including a fluid return conduit in fluid communication with the cleaning location and the tank, the cleaning system further including a source of rinsing fluid in fluid communication with the cleaning location, the cleaning system further including a drain in fluid communication with the cleaning location, the control system comprising:

a sensor located in the tank, the sensor outputting concentration signals indicative of a concentration of a component of the cleaning mixture in the tank; and a controller having a processor and a data storage means, the processor being in communication with the sensor and the data storage means, wherein the controller is configured to executed a program stored in the controller to:

record in the data storage means a data table including (i) time intervals during a period of operation of the cleaning system, and (ii) concentration values associated with each of the time intervals, the concentration values being derived by the processor from concentration signals received from the sensor.

16. The control system of claim 15 wherein:

the processor is also in communication with the pump for providing on signals and off signals to the pump for turning on and turning off the pump, and the controller also records in the data table pump operating status values associated with each of the time intervals, the pump operating status values being indicative of the on signals and the off signals provided by the processor to the pump.

17. The control system of claim 15 wherein:

the processor is also in communication with the pump for providing on signals and off signals to the pump for turning on and turning off the pump, and the controller executes the program stored in the controller to provide an off signal to the pump at a predetermined time period after an on signal is provided to the pump.

18. The control system of claim 17 wherein:

the predetermined time period can be modified in the program using the processor.

19. The control system of claim 17 wherein:

the controller includes an activation button to provide the on signal to the pump.

20. The control system of claim 15 wherein:

the processor is also in communication with the pump for providing on signals and off signals to the pump for turning on and turning off the pump, and the controller executes the program stored in the controller to provide an off signal to the pump when the sensor outputs a concentration signal of a predetermined concentration value after an on signal is provided to the pump.

21. The control system of claim 20 wherein:

the predetermined concentration value can be modified in the program using the processor.

22. The control system of claim 20 wherein:

the controller executes the program stored in the controller to provide an alarm signal if the sensor outputs a concentration signal that goes above or below the predetermined concentration value.

23. The control system of claim 20 wherein:

the controller includes an activation button to provide the on signal to the pump.

24. The control system of claim 15 wherein:

the cleaning system further includes a second pump for supplying a second cleaning chemical to a second tank for holding a second cleaning mixture of the second cleaning chemical and a second diluting fluid, the second tank being in fluid communication with the fluid supply conduit and the fluid return conduit, the control system further includes a second sensor located in the second tank, the second sensor outputting second concentration signals indicative of a concentration of a component of the second cleaning mixture in the second tank, and the controller also records in the data table second concentration values associated with each of the time intervals, the second concentration values being derived by the processor from second concentration signals received from the second sensor.

25. The control system of claim 24 wherein:

the control system further includes a third sensor located in a fluid path between the cleaning location and the drain, the third sensor outputting third concentration signals indicative of a concentration of a component of fluid passing the third sensor, the controller also records in the data table third concentration values associated with each of the time intervals, the third concentration values being derived by the processor from third concentration signals received from the third sensor.

26. The control system of claim 24 wherein:

the processor is also in communication with the second pump for providing on signals and off signals to the second pump for turning on and turning off the second pump, and the controller also records in the data table second pump operating status values associated with each of the time intervals, the second pump operating status values being indicative of the on signals and the off signals provided by the processor to the second pump.

27. A control system for a cleaning system including a pump for supplying a cleaning chemical to a tank for holding a cleaning mixture of the cleaning chemical and a diluting fluid, the cleaning system further including a fluid supply conduit in fluid communication with a cleaning location and the tank, the cleaning system further including a fluid return conduit in fluid communication with the cleaning location and the tank, the cleaning system further including a source of rinsing fluid in fluid communication with the cleaning location, the cleaning system further including a drain in fluid communication with the cleaning location, the control system comprising:

a sensor located in the fluid supply conduit, the sensor outputting concentration signals indicative of a concentration of a component of fluid passing the sensor; and a controller having a processor in communication with a data storage means and the sensor, the processor also being in communication with the pump for providing on signals and off signals to the pump for turning on and turning off the pump, wherein the controller is configured to executed a program stored in the controller to:

record in the data storage means a data table including (i) time intervals during a period of operation of the cleaning system, (ii) pump operating status values associated with each of the time intervals, the pump operating status values being indicative of the on signals and the off signals provided by the processor to the pump, and (iii) concentration values associated with each of the time intervals, the concentration values being derived by the processor from concentration signals received from the sensor.

28. The control system of claim 27 wherein:

the cleaning system further includes a second pump for supplying a second cleaning chemical to a second tank for holding a second cleaning mixture of the second cleaning chemical and a second diluting fluid, the second tank being in fluid communication with the fluid supply conduit and the fluid return conduit, and the processor is also in communication with the second pump for providing on signals and off signals to the second pump for turning on and turning off the second pump, and the controller also records in the data table second pump operating status values associated with each of the time intervals, the second pump operating status values being indicative of the on signals and the off signals provided by the processor to the second pump.

29. The control system of claim 27 wherein:

the controller executes the program stored in the controller to provide an off signal to the pump at a predetermined time period after an on signal is provided to the pump.

30. The control system of claim 29 wherein:

the predetermined time period can be modified in the program using the processor.

31. The control system of claim 29 wherein:

the controller includes an activation button to provide the on signal to the pump.

32. The control system of claim 27 wherein:

the controller executes the program stored in the controller to provide an off signal to the pump when the sensor outputs a concentration signal of a predetermined concentration value after an on signal is provided to the pump.

33. The control system of claim 32 wherein:

the predetermined concentration value can be modified in the program using the processor.

34. The control system of claim 32 wherein:

the controller executes the program stored in the controller to provide an alarm signal if the sensor outputs a concentration signal that goes above or below the predetermined concentration value.

35. The control system of claim 32 wherein:

the controller includes an activation button to provide the on signal to the pump.

36. The control system of claim 27 wherein:

the controller executes the program to download the data table via an interface to a computer or wirelessly transmit the data table to a computer.

37. The control system of claim 27 wherein:

the cleaning system further includes a second pump for supplying a second cleaning chemical to the tank, and the processor is also in communication with the second pump for providing on signals and off signals to the second pump for turning on and turning off the second pump, and the controller includes an activation button to provide on signals to the pump and the second pump.

38. A control system for a cleaning system including a pump for supplying a cleaning chemical to a tank for holding a cleaning mixture of the cleaning chemical and a diluting fluid, the cleaning system further including a fluid supply conduit in fluid communication with a cleaning location and the tank, the cleaning system further including a fluid return conduit in fluid communication with the cleaning location and the tank, the cleaning system further including a source of rinsing fluid in fluid communication with the cleaning location, the cleaning system further including a drain in fluid communication with the cleaning location, the control system comprising:

a sensor located in the tank, the sensor outputting concentration signals indicative of a concentration of a component of the cleaning mixture in the tank; and a controller having a processor in communication with a data storage means and the sensor, the processor also being in communication with the pump for providing on signals and off signals to the pump for turning on and turning off the pump, wherein the controller is configured to execute a program stored in the controller to:

record in the data storage means a data table including (i) time intervals during a period of operation of the cleaning system, (ii) pump operating status values associated with each of the time intervals, the pump operating status values being indicative of the on signals and the off signals provided by the processor to the pump, (iii) concentration values associated with each of the time intervals, the concentration values being derived by the processor from concentration signals received from the sensor.

39. The control system of claim 38 wherein:

the controller executes the program stored in the controller to provide an off signal to the pump at a predetermined time period after an on signal is provided to the pump.

40. The control system of claim 38 wherein:

the controller executes the program stored in the controller to provide an off signal to the pump when the sensor outputs a concentration signal of a predetermined concentration value after an on signal is provided to the pump.

* * * * *

UNITED STATES PATENT AND TRADEMARK OFFICE

CERTIFICATE OF CORRECTION

PATENT NO. : 7,614,410 B2
APPLICATION NO. : 11/069702
DATED : November 10, 2009
INVENTOR(S) : Kenowski et al.

It is certified that error appears in the above-identified patent and that said Letters Patent is hereby corrected as shown below:

Column 19, line 27 "executed" should be -- execute --

Column 21, line 7 "executed" should be -- execute --

Column 22, line 50 "executed" should be -- execute --

Signed and Sealed this

Twenty-ninth Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,614,410 B2
APPLICATION NO. : 11/069702
DATED : November 10, 2009
INVENTOR(S) : Kenowski et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 945 days.

Signed and Sealed this

Nineteenth Day of October, 2010

David J. Kappos

David J. Kappos
*Director of the United States Patent and Trademark Office*